US008183954B2

(12) United States Patent
Yano

(10) Patent No.: US 8,183,954 B2
(45) Date of Patent: May 22, 2012

(54) COAXIAL LINE TO WAVEGUIDE CONVERTER WITH AN ADJUSTABLE CONDUCTOR ATTACHED TO THE COAXIAL LINE INNER CONDUCTOR

(75) Inventor: Koji Yano, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 222 days.

(21) Appl. No.: 12/614,145

(22) Filed: Nov. 6, 2009

(65) Prior Publication Data

US 2010/0117757 A1 May 13, 2010

(30) Foreign Application Priority Data

Nov. 7, 2008 (JP) ..... 2008-286262

(51) Int. Cl.
*H01P 5/103* (2006.01)

(52) U.S. Cl. ..... 333/26

(58) Field of Classification Search ..... 333/26, 333/34

See application file for complete search history.

(56) References Cited

U.S. PATENT DOCUMENTS

| | | | | |
|---|---|---|---|---|
| 2,527,146 | A * | 10/1950 | Mumford | 333/33 |
| 4,144,506 | A * | 3/1979 | McCammon et al. | 333/26 |
| 6,111,474 | A * | 8/2000 | Nibe | 333/26 |
| 2007/0109178 | A1 * | 5/2007 | Schultheiss | 342/124 |
| 2008/0246553 | A1 | 10/2008 | Okamoto | |

FOREIGN PATENT DOCUMENTS

| | | | |
|---|---|---|---|
| JP | 62293801 | A | 12/1987 |
| JP | 2007-88797 | A | 4/2007 |
| SU | 1133631 | A1 | 1/1985 |
| SU | 1675975 | A1 | 9/1991 |

* cited by examiner

*Primary Examiner* — Benny Lee

(74) *Attorney, Agent, or Firm* — Birch, Stewart, Kolasch & Birch, LLC

(57) ABSTRACT

A coaxial waveguide converter is disclosed. It includes a waveguide to which a high frequency signal is transmitted, a coaxial line having an inner conductor that is coupled to the waveguide so as to project an end of the inner conductor into the waveguide, and a first adjustment conductor provided on the periphery of the projected end part of the inner conductor so as to be movable in the axial direction of the inner conductor.

9 Claims, 8 Drawing Sheets

COAXIAL LINE TO WAVEGUIDE CONVERTER WITH AN ADJUSTABLE CONDUCTOR ATTACHED TO THE COAXIAL LINE INNER CONDUCTOR

CROSS-REFERENCE TO RELATED APPLICATIONS(S)

This application claims priority under 35 U.S.C. §119 to Japanese Patent Application No. 2008-286262, which was filed on Nov. 7, 2008, the entire disclosure of which is hereby incorporated by reference.

TECHNICAL FIELD

The present invention relates to a coaxial waveguide converter for converting a high frequency signal between a waveguide and a coaxial line connected to the waveguide.

BACKGROUND

In a radar instrument for detecting a target object using a high frequency signal, a slot antenna or the like is typically provided to an end of a waveguide, for example. The high frequency signal is transmitted out of the radar instrument via a slot of the antenna. For such a radar instrument, in order to improve the flexibility of attachment of the instrument, a coaxial line is typically used for transmission of the high frequency signal through the radar instrument. In this case, conversion of the high frequency signal is necessary between the waveguide and the coaxial line and, thus, a coaxial waveguide converter is used therebetween. The coaxial waveguide converter typically carries out impedance matching between the waveguide and the coaxial line to optimize the transmission efficiency.

FIG. 9 shows a vertical cross-section of a conventional coaxial waveguide converter 100. The coaxial waveguide converter 100 typically includes a waveguide 10, an outer conductor 20, an inner conductor 30, and a matching section 13. Hereinafter, the configuration of this conventional coaxial waveguide converter 100 will be described in detail.

An insertion hole 11 is formed in the waveguide 10, and a coaxial line including the outer conductor 20 and the inner conductor 30 is attached to the waveguide 10 through the insertion hole 11. The inner conductor 30 is provided coaxially with the outer conductor 20 and is fitted inside the outer conductor 20 via an insulator 12. An end of the inner conductor 30 projects from the corresponding end of the outer conductor 20 into the waveguide 10 via the insertion hole 11. Although the coaxial line is connected to the waveguide 10 via a known coaxial connector, the description and illustration of the coaxial connector are omitted herein. In addition, the matching section 13 for adjusting impedance is provided to the waveguide 10. A load component (not illustrated), such as a slot antenna, is typically attached to the waveguide 10 via the matching section 13.

In the case of such a conventional coaxial waveguide converter 100, a redundant space where the matching section 13 is placed must be provided. In addition, according to the load (e.g., slot antenna) and the frequency of the high frequency signal which passes through the coaxial waveguide converter 100, the matching section 13 may be necessary to be changed in its size and shape. Therefore, various types of the matching sections 13 may be manufactured and prepared in advance to meet the requirements immediately.

To get around this requirements, JP 2007-88797(A) discloses a coaxial waveguide converter which can adjust the impedance corresponding to the various loads and frequencies without providing the matching section 13.

The coaxial waveguide converter disclosed in JP 2007-88797(A) has a short board provided inside a waveguide, which is movable in the axial direction of the waveguide. In addition, the position of a probe provided to a tip end of an inner conductor is adjustable in a direction perpendicular to the axial direction of the waveguide. That is, the distance between the probe and the short board, and the projected length of the probe which projects inside the waveguide can be adjusted arbitrarily. Therefore, the impedance matching according to the load and frequency can be achieved with a single type of the coaxial waveguide converter.

However, even for the coaxial waveguide converter disclosed in JP 2007-88797(A), because the short board must be provided, the redundant space must still be provided. In addition, prior to changing the projected amount of the probe, the coaxial waveguide converter must be disassembled. Particularly, if one just wants to tune the probe finely, the disassembly is very troublesome. Further, when the coaxial waveguide converter is used with a radar instrument having a rotary antenna section, the position of the short board and/or the position of the probe may shift due to the rotation or vibration caused by the antenna section. Therefore, the impedance matching may be difficult to be carried out.

SUMMARY OF THE INVENTION

The present invention is thus made in view of the situations described above, and provides an improved coaxial waveguide converter.

According to an aspect of the present invention, a coaxial waveguide converter includes a waveguide to which a high frequency signal is transmitted, a coaxial line having an inner conductor that is coupled to the waveguide so as to project an end of the inner conductor into the waveguide, and a first adjustment conductor provided on the periphery of the projected end part of the inner conductor so as to be movable in the axial direction of the inner conductor.

Thus, because the first adjustment conductor movable in the axial direction is provided on the periphery of the inner conductor, impedance matching corresponding to a load component connected to the waveguide and/or frequency of a signal passing through the coaxial waveguide converter can be adjusted without providing an redundant space separately.

The coaxial waveguide converter may further include a second adjustment conductor provided to the projected tip end of the inner conductor so as to project from the tip end, and its projected amount from the tip end being adjustable.

The first adjustment conductor may be formed in a double-nut shape including two flange-shaped parts threadedly engaged with the inner conductor.

The two flange-shaped parts may be formed substantially in an identical shape.

One of the two flange-shaped parts may have a concave part surrounding the inner conductor, and the other flange-shaped part may have a periphery shape such that it substantially conforms to the concave part.

The coaxial waveguide converter may further include a lid removably provided to the waveguide at a location opposing to the projected end part of the inner conductor.

At least one of the first flange-shaped part and the second flange-shaped part may have a concave or convex shaped face thereof exposed toward the removable lid.

The coaxial waveguide converter may further include an insulator made of an insulating material provided to the second adjustment conductor so as to have a larger peripheral diameter than that of the second adjustment conductor.

The removable lid may be formed with a concave or convex shaped face thereof where the insulator fits.

According to another aspect of the present invention, a radar instrument for detecting a target object by transceiving the high frequency signal includes the coaxial waveguide converter described above.

BRIEF DESCRIPTION OF THE DRAWINGS

The present disclosure is illustrated by way of example and not by way of limitation in the figures of the accompanying drawings in which the like reference numerals indicate like elements and in which.

DETAILED DESCRIPTION OF THE INVENTION

Hereinafter, several embodiments of the present invention will be described referring to the appended drawings illustrating the configurations of a coaxial waveguide converter according to the respective embodiments. Note that, in the following embodiments, the terms describing directions, such as above and below, and upper and lower, are used for illustrated purposes only, and the coaxial waveguide converter may be oriented in any directions as long as allowed by its applications, and therefore, the directions may change accordingly.

Embodiment 1

A coaxial waveguide converter according to Embodiment 1 of the invention is able to change the position of two adjustment conductors provided to an inner conductor to carry out impedance matching corresponding to arbitrary load components (for example, a slot antenna) connected to a waveguide. Hereinafter, the coaxial waveguide converter of Embodiment 1 will be described referring to FIGS. 1 to 4.

Figure 1:
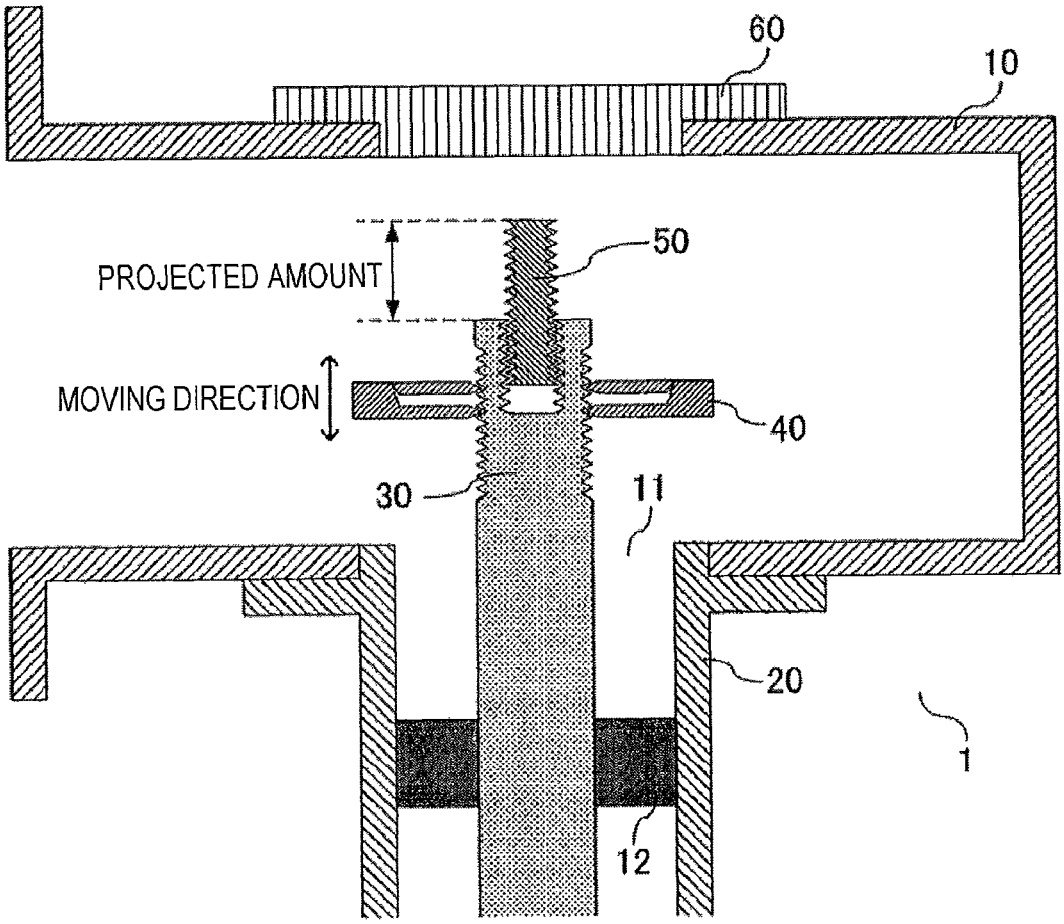
FIG. 1 is a vertical cross-section of a coaxial waveguide converter according to Embodiment 1 of the present invention.

FIG. 1 shows a vertical cross-section of a coaxial waveguide converter 1 of this embodiment. The coaxial waveguide converter 1 includes a waveguide 10, an outer conductor 20, an inner conductor 30, a first adjustment conductor 40, a second adjustment conductor 50, and a removable lid 60.

The waveguide 10 is a hollow rectangular cross-section waveguide having one end opened, and a load such as a slot antenna (not illustrated) is typically connected to the open end by flange coupling, etc. The waveguide 10 may have any other cross-sectional shape other than the rectangular shape as described above. A circular insertion hole 11 is formed in a face of the waveguide 10 perpendicular to the open end.

The outer conductor 20 made of an conductive material has a hollow cylindrical shape and is coupled to the waveguide 10 via the insertion hole 11 so that the outer conductor 20 has an inner diameter equal to the diameter of the insertion hole 11. The inner conductor 30 made of a conductive material is provided inside the outer conductor 20 via the insulator 12 so as to coaxial with the outer conductor 20. The inner conductor 30 projects upwardly inside the waveguide 10 through the insertion hole 11, and the periphery of the projected part of the inner conductor 30 is formed with threads. In addition, a threaded hole is formed in a projected-side (top) end face of the inner conductor 30.

The first adjustment conductor 40 made of a conductive material is provided on the periphery of the inner conductors 30 where the threads are formed. The first adjustment conductor 40 has an annular or flange shape, is formed with a threaded hole at the center, having a diameter equal to the outer diameter of the inner conductor 30 to threadedly engage with the inner conductor 30. As rotating the first adjustment conductor 40 centering on the inner conductor 30, the position of the first adjustment conductor 40 can be changed in the moving axial direction of the inner conductor 30 (the directions shown by the arrow in FIG. 1).

Figure 2:
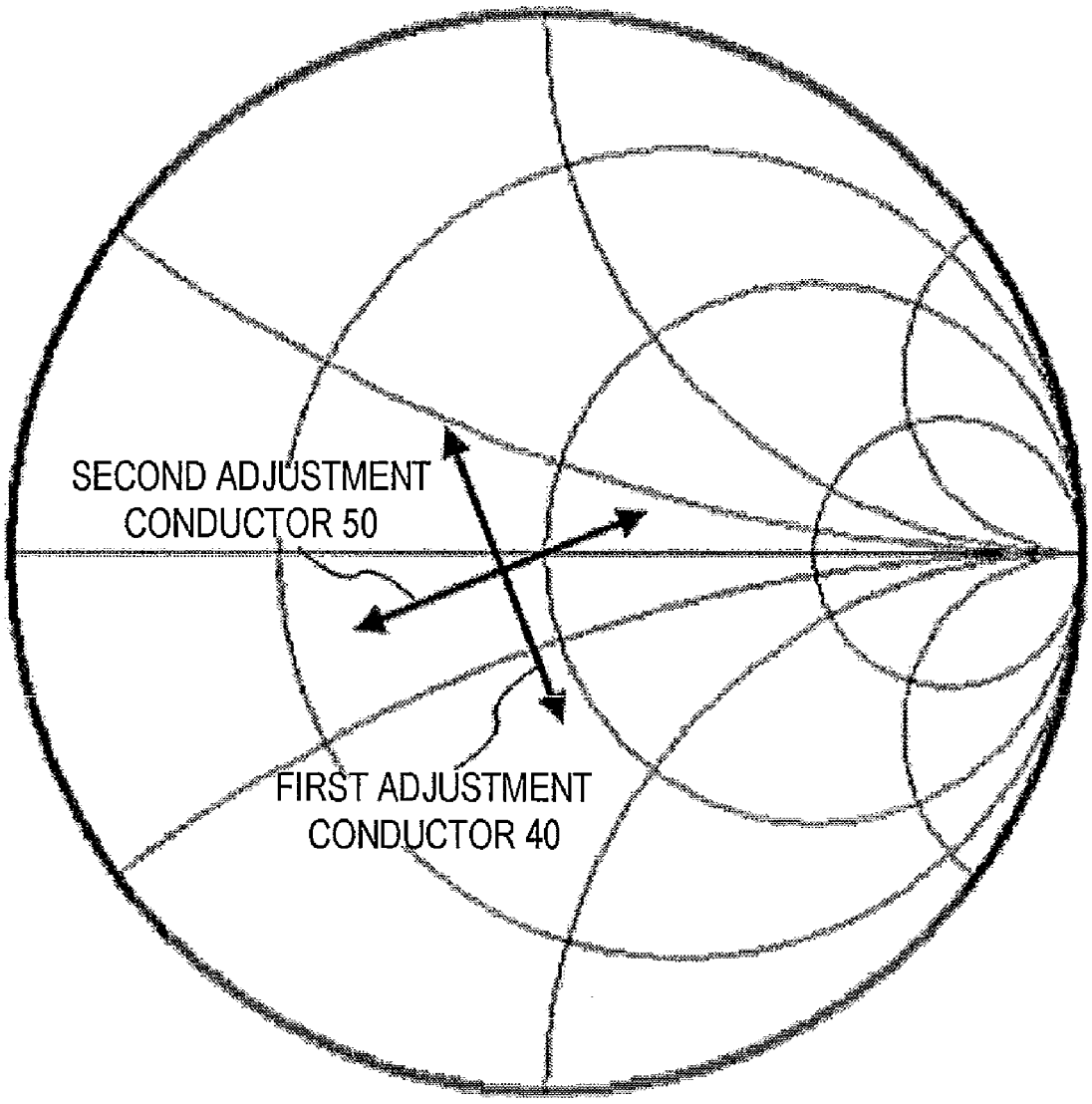
FIG. 2 is an impedance chart showing impedance corresponding to a position of a first adjustment conductor and a projected amount of a second adjustment conductor according to Embodiment 1.

Here, by changing the position of the first adjustment conductor 40, the impedance of the coaxial waveguide converter 1 changes as shown by the arrow of the first adjustment conductor 40 of the impedance chart of FIG. 2. A position fixing method of the first adjustment conductor 40 will be described later.

The second adjustment conductor 50, made of a conductive material, projects from the projected-side end face of the inner conductor 30. The second adjustment conductor 50 has its entire periphery formed with threads, and a lower part thereof is threadedly engaged with the threaded hole formed in the inner conductor 30. A projected length of the second adjustment conductor 50 from the inner conductor 30 (i.e., a projected amount) can be freely changed by how much the second adjustment conductor 50 is buried in the threaded hole formed in the inner conductor 30. By changing the projected amount, the impedance of the coaxial waveguide converter 1 changes as the arrow of the second adjustment conductor 50 in the impedance chart of FIG. 2.

The removable lid 60 is attached to the waveguide 10 at a position opposing to insertion hole 11 (i.e., opposing to the projected end of the inner conductor 30). By removing the removable lid 60, the corresponding part of the waveguide 10 can be opened to allow an operator's access inside the waveguide 10 to the adjustment conductors 40 and 50. Thus, just by removing the removable lid 60, the operator can access the first adjustment conductor 40 to move its axial position and/or the second adjustment conductor 50 to change its projected amount. Thereby, the impedance can be adjusted without disassembling the coaxial waveguide converter 1 from the coaxial line side.

Figure 3A:
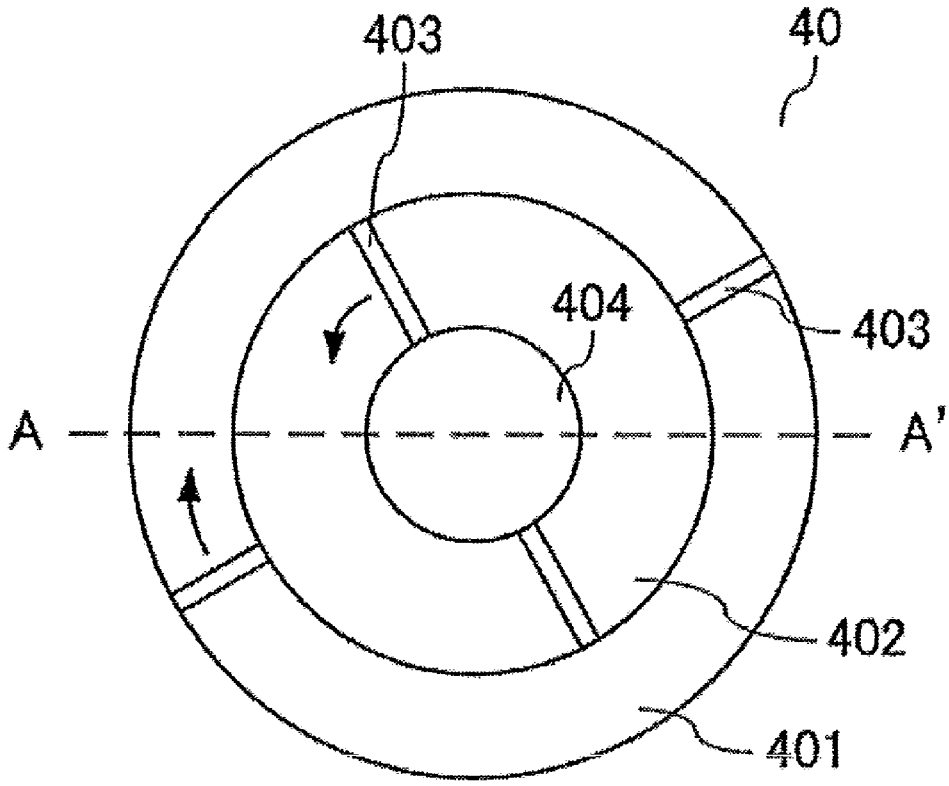
FIG. 3A is a plan view illustrating the first adjustment conductor according to Embodiment 1.
Figure 3B:
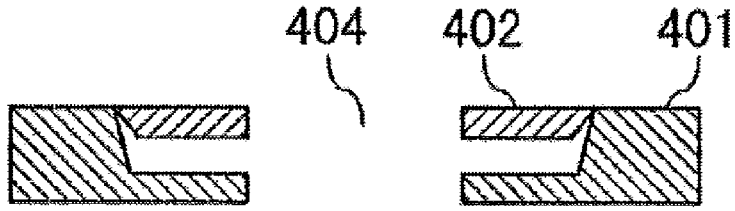
FIG. 3B is a vertical cross-section illustrating the first adjustment conductor.
Figure 4:
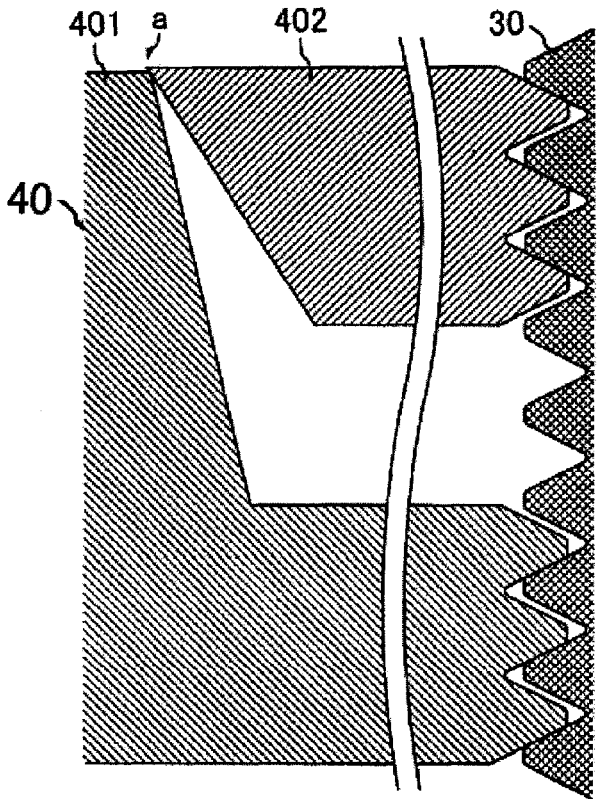
FIG. 4 is an enlarged partial cross-section of FIG. 3B, illustrating threadedly-engagement of the first adjustment conductor with the inner conductor according to Embodiment 1.

Next, the detailed structure and position fixing method of the first adjustment conductor 40 will be described referring to FIGS. 3A and 3B, and FIG. 4. FIG. 3A is a plan view of the first adjustment conductor 40, and FIG. 3B is a cross-section of the first adjustment conductor 40 taken along the line A-A' of FIG. 3A. FIG. 4 is a partially enlarged view of FIG. 3B showing threadedly-engagement of the first adjustment conductor 40 with the inner conductor 30. The first adjustment conductor 40 includes a first flange part 401 and a second flange part 402, and its position can be is fixed by a double-nut structure achieved by the combination of the first and second flange parts 401 and 402.

The first flange part 401 made of a conductive material has an annular shape, and is formed with a threaded hole 404 (FIGS. 3A and 3B) with which the inner conductor 30 is threadedly engaged. The first flange part 401 may be any other shape. The first flange part 401 is formed with an annular recess on one side thereof (in this embodiment, the side facing to the removable lid, that is, upward), whose diameter is greater than the threaded hole 404. The second flange part 402 made of a conductive material is inserted in the recess and, thus, the second flange part 402 has a smaller outer diameter than the diameter of the recess. The recess has a tapered peripheral wall so that its diameter becomes smaller as it goes to deeper side (i.e., downwardly).

The second flange part 402 has an annular shape having a threaded hole 404 for threadedly engaged with the inner conductor 30 similar to the first flange part 401. The peripheral diameter of the second flange part 402 is narrowed from its upper end toward its lower end, and the peripheral diameter of the second flange part 402 at its upper end is substantially equal to the diameter of the recess formed in the first flange part 401.

As described above, the first flange part 401 and the second flange part 402 constitute the double-nut structure. The first flange part 401 and the second flange part 402 are threadedly engaged with the inner conductor 30 independently from each other via their respective threads. Thus, as the first flange part 401 and the second flange part 402 are rotated in the opposite directions as shown by the arrows in FIG. 3A, they can be moved toward the directions so as to be tightened mutually. Then, the first flange part 401 and the second flange part 402 can be fixed to a predetermined position along the inner conductor 30 by their double-nut structure.

When the first flange part 401 and the second flange part 402 are tightened together, the first flange part 401 and the second flange part 402 contact to each other at a point "a" shown in FIG. 4. Then, the first flange part 401 and the second flange part 402 push one another so that they receive reaction forces in the opposite directions from their tightening directions. Therefore, the threads of the first flange part 401 contact the upper faces of thread grooves of the inner conductor 30 and the threads of the second flange part 402 contact the lower faces of the thread grooves of the inner conductor 30 so that the first flange part 401 and the second flange part 402 are tightened by the double-nut structure to be fixed at the predetermined position.

As described above, the threads of the first flange part 401 and the threads of the second flange part 402 can engage at the predetermined position with the threaded grooves of the inner conductor 30 so as to eliminate the backlash of the threads. Thereby, variation in a high frequency current flow due to the backlash can be suppressed. Note that the upper face of the second flange part 402 slightly protrudes from the upper face of the first flange part 401 in FIG. 4; however, this does not interrupt the high frequency current flow. Rather, the first flange part 401 and the second flange part 402 can be considered as a single integrated conductor (the first adjustment conductor 40 as shown in FIG. 3A) in this embodiment by their tight electrical coupling. In other words, the upper face of the first flange part 401 may protrude from the upper face of the second flange part 402, or alternatively, both the upper faces may substantially constitute a continuous single plane as shown in FIG. 3B.

In addition, a notch 403 (FIG. 3A) of a shape into which the tip end of a tool, such as a minus driver or dedicated tool, fits is formed on one side (upper face in this embodiment) of the first flange part 401 and the second flange part 402. Two or more notches 403 may be formed in each of the flange parts 401 and 402. In this embodiment, two notches 403 are formed on each face of the flange parts 401 and 402 so as to oppose to the removable lid 60 attached to the waveguide 10 when the flange parts 401 and 402 are threadedly engaged with the inner conductor 30.

Alternatively, the notch may be formed in any other shape including concave or convex, and may be formed at any other location on the flange part as long as it is accessible by the tool via the opening of the removable lid 60 (FIG. 1).

By forming such notches 403, the first flange part 401 and the second flange part 402 can be rotated one by one from the outside of the waveguide 10 (FIG. 1) to change the position of the first adjustment conductor 40 by using the tool from the relatively small opening formed in the waveguide 10 for the removable lid 60 (FIG. 1). Therefore, the position of the first adjustment conductor 40 can be changed without disassembling the entire coaxial waveguide converter 1 (FIG. 1) to adjust the impedance of the coaxial waveguide converter 1.

Embodiment 2

Figure 5:
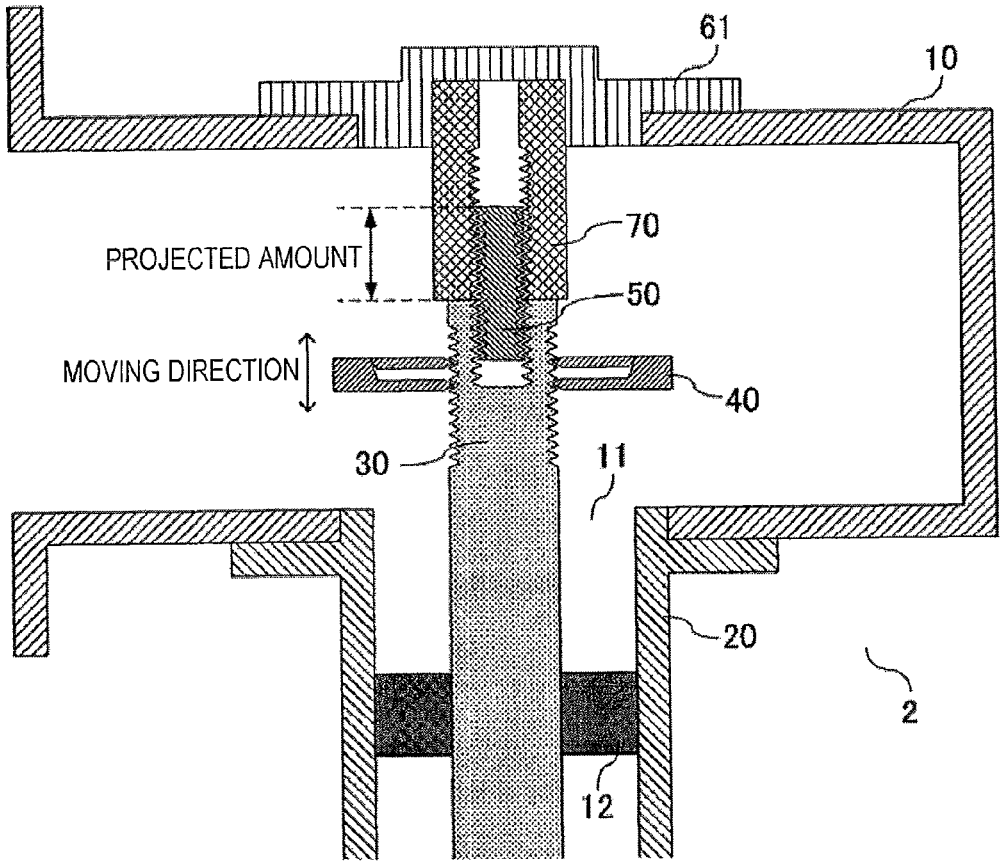
FIG. 5 is a vertical cross-section illustrating a coaxial waveguide converter according to Embodiment 2 of the invention.

A coaxial waveguide converter 2 according to Embodiment 2 of the invention differs from the coaxial waveguide converter 1 of Embodiment 1 in that an insulator is additionally provided to the second adjustment conductor and the shape of the removable lid is modified accordingly. Hereinafter, the coaxial waveguide converter 2 of this embodiment is described referring to FIG. 5. Like reference numerals are given to like components to those of Embodiment 1 and, thus, description thereof is herein omitted.

An insulator 70 made of a non-conductive resin containing fluorine, for example, is provided to the second adjustment conductor 50. The insulator 70 is formed in a cylindrical shape in this embodiment, and female threads are formed on the inner periphery of the insulator 70. The insulator 70 is threadedly engaged with the threaded outer periphery of the second adjustment conductor 50. The bottom end of the insulator 70 closely contacts the top end of the inner conductor 30, and the bottom end thereof closely contacts a lower face of a removable lid 61 whose configuration is described later in detail.

Similar to Embodiment 1, the removable lid 61 with which the insulator 70 contacts is formed at a location which opposes to the insertion hole 11 of the waveguide 10 (i.e., a location which intersects with the axis of the inner conductor 30). By removing the removable lid 61, the corresponding part of the waveguide 10 can be opened. Therefore, only by removing the removable lid 61, the first adjustment conductor 40 can be moved and/or the projected amount of the second adjustment conductor 50 can be changed to adjust the impedance without disassembling the coaxial waveguide converter 2 from the coaxial line side.

The insulator 70 may be of any shape other than cylindrical as described above as long as it can be easily toggled by fingers of the operator through the opening which is covered with the removable lid 61.

In addition to the configuration described above, the removable lid 61 of this embodiment is formed with a concave part into which an upper part of the insulator 70 fits. Thus, the concave part may be of any shape to conform to the shape of the insulator 70 described above. Because the insulator 70 is fitted and fixed to the removable lid 61 and the bottom end of the insulator 70 closely contacts the top end of the inner conductor 30, the insulator 70 is stabilized in position, and thereby the second adjustment conductor 50 as well as the inner conductor 30 and the first adjustment conductor 40 are also stabilized.

Embodiment 3

A coaxial waveguide converter 3 according to Embodiment 3 of the invention differs from the coaxial waveguide converters 1 and 2 of Embodiments 1 and 2 in the shapes of the first adjustment conductor and the insulator. Hereinafter, the coaxial waveguide converter 3 of this embodiment is described referring to FIGS. 6, 7A, and 7B. Like reference numerals are given to like components to those of Embodiments 1 and 2, and description is thus omitted.

Figure 6:
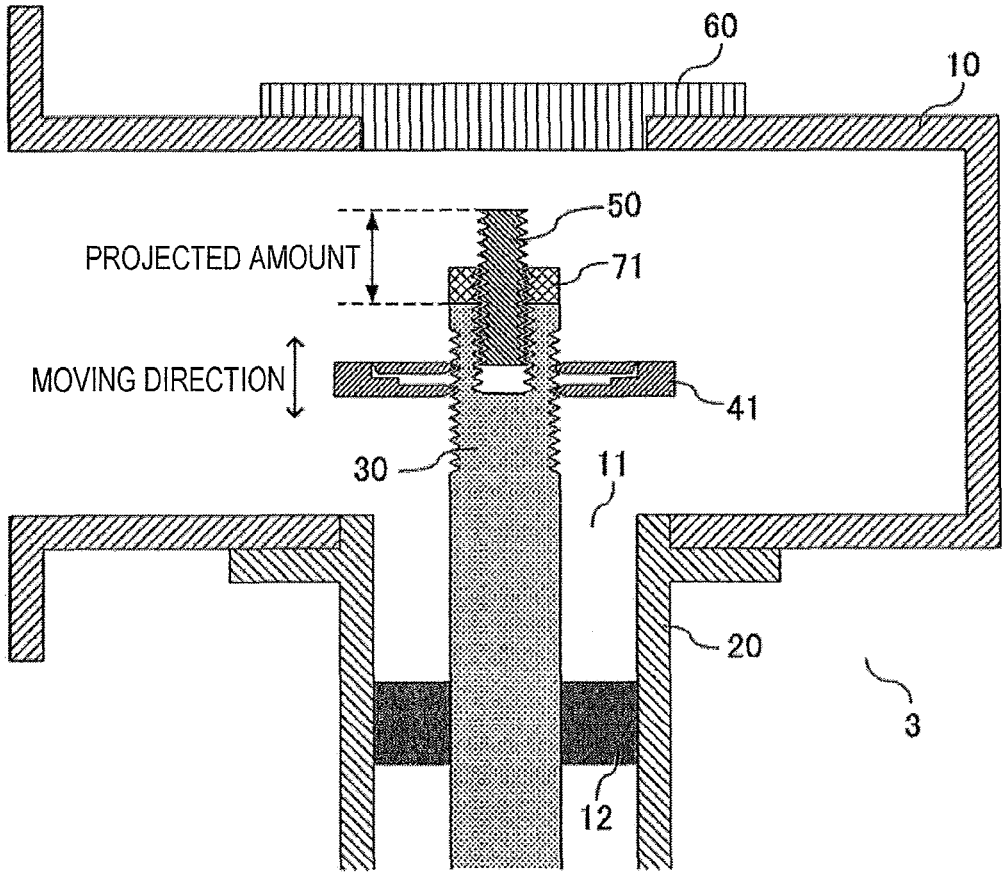
FIG. 6 is a vertical cross-section illustrating a coaxial waveguide converter according to Embodiment 3 of the invention.

As shown in FIG. 6, a first adjustment conductor 41 made of a conductive material is provided on the periphery of the inner conductors 30 where the threads are formed and an insulator 71 made of a resin containing an insulating material such as fluorine, for example, is provided to the second adjustment conductor 50. In this embodiment, the insulator 71 is formed in a short nut shape, and is threadedly engaged with the threaded periphery of the second adjustment conductor 50 so that the bottom end of the insulator 71 closely contacts the top end of the inner conductor 30 and the upper end of the second adjustment conductor projects upwardly from the top end of the insulator 71. Thus, upon fixing the second adjustment conductor 50, the insulator 71 is threadedly engaged with the second adjustment conductor 50 until the bottom end of the insulator 71 closely contacts the top end of the inner conductor 30 so that the second adjustment conductor 50 is stably fixed to the inner conductor 30.

Figure 7A:
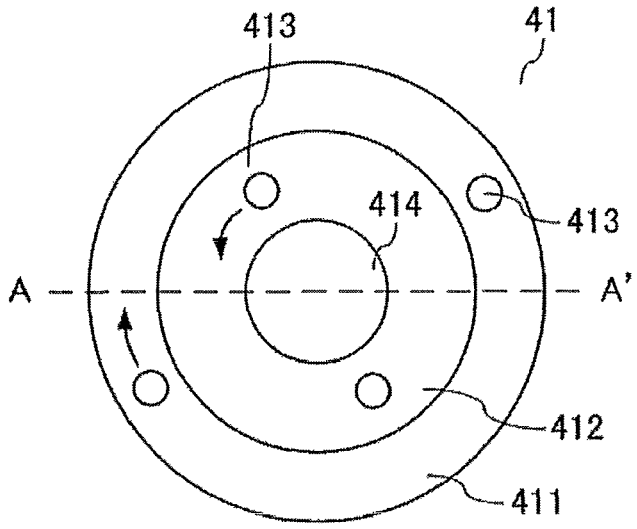
FIG. 7A is a plan view illustrating a first adjustment conductor according to Embodiment 3.
Figure 7B:
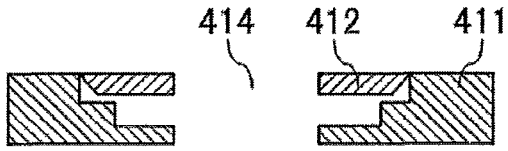
FIG. 7B is a vertical cross-section illustrating the first adjustment conductor.

As shown in FIG. 7A and similar to the previous embodiments, the first adjustment conductor 41 of this embodiment includes a first flange part 411 and a second flange part 412. The first flange part 411 made of a conductive material has an annular shape having a threaded hole 414 (FIGS. 7A and 7B) at its center for threadedly engaging with the threaded periphery of the inner conductor 30. The outer contour of the first flange part 411 may be of any other shape such as square, rectangular, etc. The first flange part 411 is formed with a concave part on its upper face, which is larger than the threaded hole 414. The second flange part 412 is inserted in this concave part. Contrary to the previous embodiments, the concave part of this embodiment is formed in a cylindrical shape without the inclined peripheral wall, that is, in the side cross-section of FIG. 7B along line A-A' of FIG. 7A, it is formed in a perpendicular step shape so that the diameter does not change in its depth direction. Although the concave part has a double-step shape in FIG. 7B, it may be a single-step shape.

The second flange part 412 also made of a conductive material has an annular shape having a threaded hole 414 at its center for threadedly engaging with the threaded periphery of the inner conductor 30 similar to the first flange part 411 described above. The outer periphery of the second flange part 412 is inclined so that it narrows downwardly. The largest outer diameter of the second flange part 412 is substantially the same as the diameter of the concave part formed in the first flange part 411.

As similar to the previous embodiments, the first flange part 411 and the second flange part 412 are engaged with each other by their double-nut structure to fix their position in the axial direction. Further, because the first flange part 411 and the second flange part 412 threadedly engage with the inner conductor 30 independently from each other, they are tightened to one another by rotating the first flange part 411 and the second flange part 412 oppositely in the arrow directions shown in FIG. 7A, respectively, and thereby their positions can be fixed.

Instead of the notches 403 in the previous embodiments, a circular hole 413 (FIG. 7A) is formed on the upper face of the first flange part 411 and the second flange part 412, respectively. Two or more holes 413 may be formed in each flange part, and in this embodiment, two holes are formed in each flange part. The holes 413 are formed on a face of each flange part opposing to the removable lid 60 attached to the waveguide 10 when the first flange part 411 and the second flange part 412 are threadedly engaged with the inner conductor 30 so that the holes are accessible from the opening of the removable lid 60, as described in the previous embodiment. Each hole may be formed in any shape to conform to the shape of the tool inserted through the opening of the removable lid 60 and, thus, it may be a circular or hexagonal shape to conform to a bar-shaped tool or hex wrench. Alternatively, the hole may be threaded to be engaged with a relatively long bolt so that an operator does not need any tools and can uses the bolt which may be stored in his tool box. Alternatively, the hole may be perforated through the flange part.

Alternatively, the hole may be formed in any other shape including concave or convex, and may be formed at any other location on the flange part as long as it is reachable by the tool via the opening of the removable lid 60 as described in the previous embodiment.

By forming such holes 413, the first flange part 401 and the second flange part 402 can be rotated one by one from the outside of the waveguide 10 to change the position of the first adjustment conductor 41 (FIG. 6) by using the tool from the relatively small opening formed in the waveguide 10 for the removable lid 60. Therefore, the position of the first adjustment conductor 41 (FIG. 6) can be changed without disassembling the entire coaxial waveguide converter 3 to adjust the impedance of the coaxial waveguide converter 3.

The application of the coaxial waveguide converter according to the present invention may be the case in which the impedance matching is necessary by attaching the load at the tip end of the waveguide as described in the embodiments above; however, it may be the case in which the impedance matching is necessary because the frequency bands of a signal passing though the coaxial waveguide converter differ.

Figure 8:
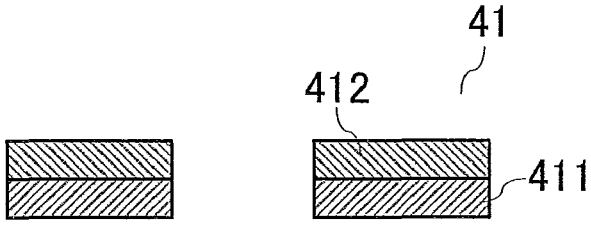
FIG. 8 is a vertical cross-section illustrating the first adjustment conductor.
Figure 9:
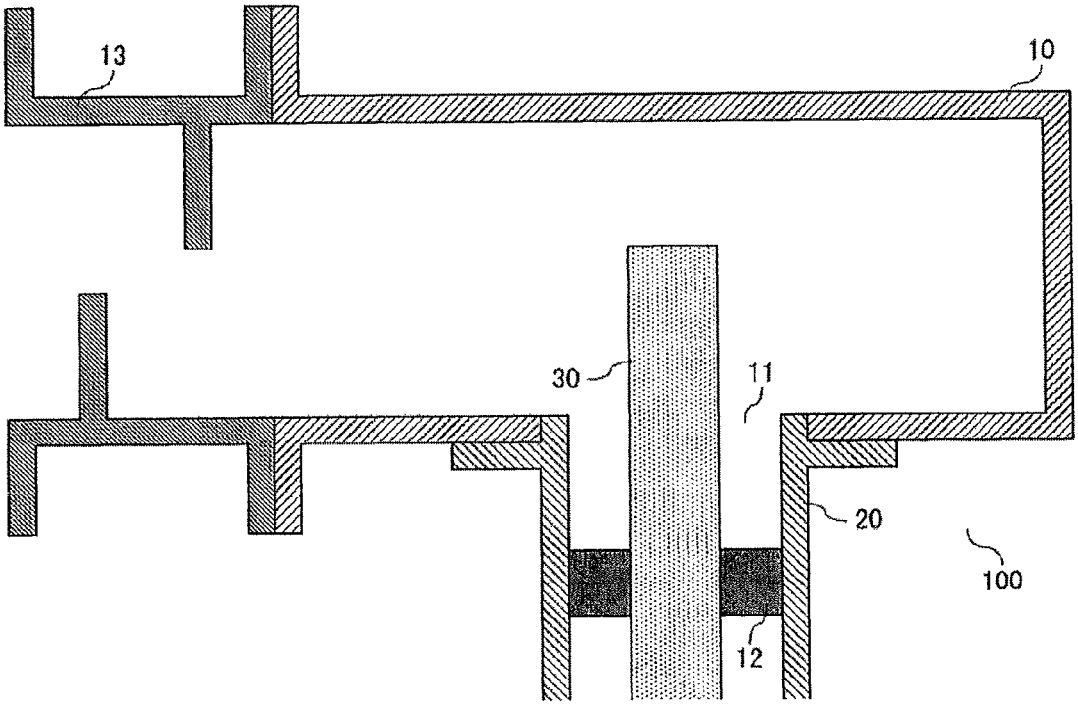
FIG. 9 (PRIOR ART)
FIG. 9 is a vertical cross-section illustrating a conventional coaxial waveguide converter.

Further, the shape of the first adjustment conductor 41 is not limited to the shape illustrated in the Embodiments 1 to 3 described above. For example, as shown in FIG. 8, the first adjustment conductor 41 may be constituted with a first flange part 411 and a second flange part 412 having the same shape as the first flange part 411.

Further, the coaxial waveguide converter according to the present invention may be used for a radar instrument for detecting a target object by transceiving the high frequency signal.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative sense rather than a restrictive sense, and all such modifications are intended to be included within the scope of the present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "approximately" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. A coaxial waveguide converter, comprising:

a waveguide to which a high frequency signal is transmitted;

a coaxial line having an inner conductor that is coupled to the waveguide so as to project an end of the inner conductor into the waveguide; and a first adjustment conductor provided on the periphery of the projected end part of the inner conductor so as to be movable in the axial direction of the inner conductor, wherein the first adjustment conductor is formed in a double-nut shape including two flange-shaped parts threadedly engaged with the inner conductor.

2. The coaxial waveguide converter of claim 1, further comprising a second adjustment conductor provided to the projected tip end of the inner conductor so as to project from the tip end, and wherein a projected amount of said second adjustment conductor from the tip end being adjustable.

3. The coaxial waveguide converter of claim 2, further comprising a lid removably provided to the waveguide at a location opposing to the projected end part of the inner conductor.

4. The coaxial waveguide converter of claim 3, further comprising an insulator made of an insulating material provided to the second adjustment conductor so as to have a larger peripheral diameter than that of the second adjustment conductor.

5. The coaxial waveguide converter of claim 4, wherein the removable lid is formed with a concave or convex shaped face thereof where the insulator fits.

6. The coaxial waveguide converter of claim 1, further comprising a lid removably provided to the waveguide at a location opposing to the projected end part of the inner conductor.

7. The coaxial waveguide converter of claim 6, wherein at least one of the two flange-shaped parts have a concave or convex shaped face thereof exposed toward the removable lid.

8. The coaxial waveguide converter of claim 1, wherein the two flange-shaped parts are formed substantially in an identical shape.

9. The coaxial waveguide converter of claim 1, wherein one of the two flange-shaped parts has a concave part surrounding the inner conductor, and the other flange-shaped part has a periphery shape such that it substantially conforms to the concave part.

* * * * *